US008033749B2

(12) United States Patent
McKenney et al.

(10) Patent No.: US 8,033,749 B2
(45) Date of Patent: Oct. 11, 2011

(54) CRASH IMPACT ATTENUATOR SYSTEMS AND METHODS

(76) Inventors: John D. McKenney, Ranchos De Taos, NM (US); Jack H. Kulp, Dana Point, CA (US)

( * ) Notice: Subject to any disclaimer, the term of this patent is extended or adjusted under 35 U.S.C. 154(b) by 0 days.

(21) Appl. No.: 12/787,250

(22) Filed: May 25, 2010

(65) Prior Publication Data

US 2010/0296864 A1 Nov. 25, 2010

Related U.S. Application Data

(63) Continuation of application No. 12/022,092, filed on Jan. 29, 2008, now Pat. No. 7,794,174.

(60) Provisional application No. 60/898,243, filed on Jan. 29, 2007.

(51) Int. Cl.
*E01F 15/00* (2006.01)

(52) U.S. Cl. ..... 404/10; 404/6; 256/13.1

(58) Field of Classification Search ..... 404/6, 9, 404/10; 256/13.1

See application file for complete search history.

(56) References Cited

U.S. PATENT DOCUMENTS

| | | | |
|---|---|---|---|
| 3,856,268 | A | 12/1974 | Fitch |
| 4,352,484 | A | 10/1982 | Gertz et al. |
| 4,452,431 | A | 6/1984 | Stephens et al. |
| 4,583,716 | A | 4/1986 | Stephens et al. |
| 4,607,824 | A | 8/1986 | Krage et al. |
| 4,674,911 | A | 6/1987 | Gertz |
| 4,681,302 | A | 7/1987 | Thompson |
| 4,784,515 | A | 11/1988 | Krage et al. |
| 4,934,661 | A | 6/1990 | Denman et al. |
| 5,022,782 | A | 6/1991 | Gertz et al. |
| 5,112,028 | A | 5/1992 | Laturner |
| 5,403,112 | A | 4/1995 | Carney, III |
| 5,733,062 | A | 3/1998 | Oberth et al. |
| 5,868,521 | A | 2/1999 | Oberth et al. |
| 6,179,516 | B1 * | 1/2001 | Ivey et al. ..... 404/6 |
| 6,427,983 | B1 | 8/2002 | Leonhardt et al. |
| 6,461,076 | B1 | 10/2002 | Stephens et al. |
| 6,481,920 | B1 | 11/2002 | Leonhardt et al. |
| 6,554,529 | B2 | 4/2003 | Stephens et al. |

(Continued)

FOREIGN PATENT DOCUMENTS

AU 731997 B2 2/2000

(Continued)

OTHER PUBLICATIONS

International Search Report, Apr. 29, 2008, corresponding PCT Application No. PCT/US08/52357; Written Opinion of the International Searching Authority, Apr. 29, 2008, corresponding PCT Application No. PCT/US08/52357.

*Primary Examiner* — Raymond Addie

(57) ABSTRACT

A reusable energy-absorbing crash attenuator comprises a base, a rail disposed on and extending along a length of the base, and a plurality of energy absorbing modules slidably disposed on the rail. Each of the energy absorbing modules comprises a first module portion and a second module portion which are attached together. Each of the module portions comprise plastic, preferably high density polyethylene (HDPE), and have a combination of concave and convex curvature. A plurality of fender panels are disposed in adjoining end-to-end fashion along each side of the length of the crash attenuator. The fender panels are arranged to slide together in telescoping fashion upon impact of the crash attenuator by a vehicle.

26 Claims, 5 Drawing Sheets

U.S. PATENT DOCUMENTS

| | | | | |
|---|---|---|---|---|
| 6,579,034 | B1 | 6/2003 | Welch et al. | |
| 6,623,204 | B2 | 9/2003 | Buehler | |
| 6,863,467 | B2 | 3/2005 | Buehler et al. | |
| 7,037,029 | B2 | 5/2006 | Buehler et al. | |
| 7,300,223 | B1 * | 11/2007 | Kennedy, Jr. et al. | 404/6 |
| 2003/0012598 | A1 | 1/2003 | Buehler | |
| 2003/0161682 | A1 | 8/2003 | Buehler et al. | |
| 2003/0165356 | A1 | 9/2003 | Breed | |
| 2003/0168650 | A1 * | 9/2003 | Alberson et al. | 256/13.1 |
| 2006/0102883 | A1 | 5/2006 | Troutman et al. | |

FOREIGN PATENT DOCUMENTS

| | | | |
|---|---|---|---|
| EP | 0474432 | A2 | 8/1991 |
| FR | 2777304 | A1 | 4/1998 |
| GB | 2229211 | A | 9/1990 |
| WO | 2005118958 | A1 | 12/2005 |

* cited by examiner

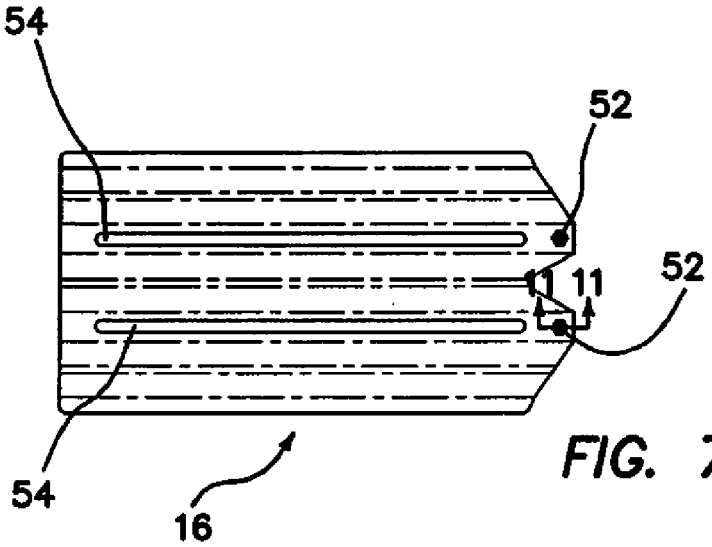
FIG. 7
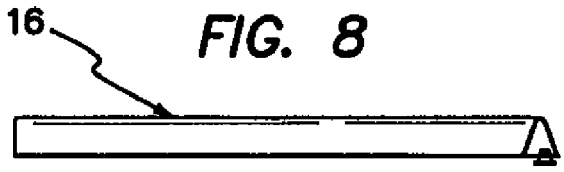
FIG. 8
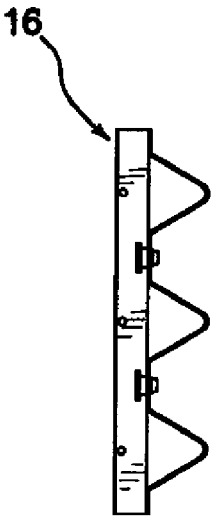
FIG. 9
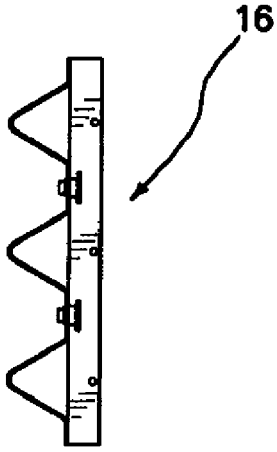
FIG. 10
FIG. 11
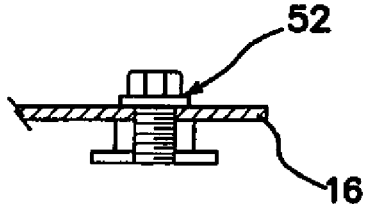

CRASH IMPACT ATTENUATOR SYSTEMS AND METHODS

This application is a continuation application under 35 U.S.C. 120 of commonly assigned U.S. patent application Ser. No. 12/022,092 entitled Crash Impact Attenuator Systems and Methods, filed Jan. 29, 2008 now U.S. Pat. No. 7,794,174, presently pending, which in turn claims the benefit under 35 U.S.C. 119(e) of the filing date of Provisional U.S. Application Ser. No. 60/898,243, entitled Crash Impact Attenuator Systems and Methods and filed on Jan. 29, 2007. Each of the above referenced applications are expressly incorporated herein by reference, in their entirety.

BACKGROUND OF THE INVENTION

The present invention relates generally to crash impact attenuators, and more particularly to motor vehicle and highway barrier crash impact attenuators constructed from molded plastic materials.

Vehicular accidents on the highway are a major worldwide problem and are undoubtedly one of the largest causes of economic and human loss and suffering inflicted on the developed world today. In an effort to alleviate, in particular, the human toll of these tragic accidents, guardrails, crash cushions, truck-mounted crash attenuators, crash barrels, and the like have been developed to attenuate the impact of the vehicle with a rigid immovable obstacle, such as a bridge abutment.

Existing plastic impact attenuators, as described in U.S. Pat. No. 5,403,112, herein expressly incorporated by reference, comprise a row of plastic tubes with retention cables. A key feature of the units is the ability to survive impact and recover to near original shape—minimizing maintenance costs. However, these existing systems, comprising an array of polyethylene cylinders attached to one another in some fashion, have a number of significant disadvantages. They are labor-intensive to assemble and material-intensive. With respect to force-deflection characteristics, existing designs are undesirable since the force increases continuously with deformation. The force cannot exceed the light vehicle limit, and therefore the initial force and deceleration is low, limiting the initial energy absorption.

With respect to maximum deformation characteristics, existing plastic attenuation systems are not ideal. A cylinder, when flattened, has extreme deformation at the outer edges so the recovery to original shape is difficult.

A crash attenuator of the type described must absorb the vehicle impact energy without exceeding limits on the vehicle deceleration. In addition, it must accommodate both heavy and light weight vehicles. The lightest vehicle will set the limit on the maximum force produced by the attenuator and the heavy vehicle—which will experience a lower deceleration, and thus will determine the total impact deformation required. The force cannot exceed the light vehicle limit and therefore the initial force and deceleration is low, limiting the energy absorption.

SUMMARY OF THE INVENTION

The present inventive concept achieves the objectives of the existing designs but offers several very significant improvements. The attenuator elements—which substitute for the tubes in existing units—consist of plastic molded components which have been fastened together. They have a convex center section and concave outer ends, which, when fastened together at the outer edges thereof form a component which is deformable to a substantially flat configuration on impact. The fastening arrangement on the ends of each attenuator element also provides attachment points for a plurality of high yield strength corrugated fender panels, which are adapted to telescope and slide on top of each other when impacted by an errant vehicle.

The thickness of the attenuator elements may be varied across their width in order to produce desired force deflection characteristics. The curvature of the concave and convex sections provides additional means of modifying the force-deflection characteristics. Also, when fully deformed, the sections do not experience the extreme deformation occurring at the outer edges of prior art cylindrical tubes.

An important feature of the present invention is its ability to recover to its original state after vehicular impact. When the attenuator elements of the invention are fully deflected or flattened, the deformation is limited to that corresponding to bending from its initial curvature to a substantially straight configuration, and the deformation force is nearly constant. By contrast, a cylinder, when flattened, has extreme deformation at the outer edges so that recovery to its original cylindrical shape is much more difficult. In the case of a cylinder, the deformation force also varies. Each inventive attenuator element can be fully flattened and recovered before installation of the crash attenuator unit. This pre-loading improves the energy absorption characteristics.

Since the attenuator elements are each open curved surfaces, use of a variety of fabrication methods is feasible, including extrusion, blow molding, and injection molding.

Another important feature of the present invention is an innovative base structure, which is designed to resist the bending resulting from an impact force on the rear. In prior art crash attenuators, the structure which resists the high impact force on the absorber elements is secured to the ground on a short mounting base. A short base produces very high loads on the ground anchors which secure it to the ground, thus necessitating many anchor bolts. In the present design, however, the end structure resisting the horizontal impact force is rigidly attached to a base structure which extends along the full length of the crash attenuator. Since the bending moment is resisted by forces at the ends of the base structure and this distance is much greater than for a short mounting base, the required anchoring forces are correspondingly small.

The inventive crash attenuator, because of the unique construction detailed in this application, is fully reusable after impact by a vehicle. As each module and the fender panels collapse during the impact, they are not permanently damage, and are reboundable to at least approximately 98% of their prior pre-crash length.

More particularly, in one aspect of the invention, there is provided a reusable energy-absorbing crash attenuator, which comprises a base, a rail disposed on and extending along a length of the base, and a plurality of energy absorbing modules slidably disposed on the rail. Each of the energy absorbing modules comprises a first module portion and a second module portion which are attached together. Each of the module portions comprise plastic, preferably high density polyethylene (HDPE), and have a combination of concave and convex curvature.

Preferably, the crash attenuator comprises a plurality of fender panels disposed in adjoining end-to-end fashion along each side of the length of the crash attenuator. The fender panels are arranged to slide together in telescoping fashion upon impact of the crash attenuator by a vehicle.

Each of the energy absorbing modules has a recess in a bottom edge thereof, wherein the recess fits over the rail to engage the rail and to slidably dispose the energy absorbing module on the rail. A nose piece is disposed proximally of a first one of the energy absorbing modules and is also slidably disposed on the rail.

In preferred embodiments, a lateral support retaining plate is disposed between adjacent ones of the energy absorbing modules. In a most preferred embodiment, employing six of the energy absorbing modules, five lateral support retaining plates are disposed between adjacent ones thereof. Each lateral support retaining plate is slidably disposed on the rail.

In a preferred embodiment, a frontmost one of the energy absorbing modules is shorter in height and a second one of the energy absorbing modules rearwardly of the frontmost module is taller in height, relative to the frontmost module. Most preferably, two adjacent frontmost ones of the modules are shorter in height, and remaining ones of the plurality of modules, rearwardly of the frontmost two modules, are taller in height.

A rear-most fender panel on one side of the attenuator is connected to a rear-most fender panel on the other side of the attenuator by at least one cable. The fender panels are each attached to corresponding ones of the energy absorbing modules by clips.

In a preferred embodiment, at least one of the plurality of energy absorbing modules is comprised of module portions having a first material thickness, and at least one other of the plurality of energy absorbing modules is comprised of module portions having a second material thickness which is less than the first material thickness. The at least one of the plurality of energy absorbing modules is disposed rearwardly of the at least one other of the plurality of energy absorbing modules, meaning that the module fabricated of thicker material is disposed rearwardly of the module fabricated of thinner material.

The first and second module portions are attached together in opposing fashion at corresponding edges thereof. The inventive crash attenuator comprises a lateral support stiffening rib disposed between adjacent ones of the energy absorbing modules. The lateral support stiffening rib is slidably disposed on the rail.

Importantly, each of the plurality of energy absorbing modules are pre-compressed, so that, after impact, they are capable of rebounding to substantially their pre-impact configuration. This permits the inventive crash attenuator to be completely reusable.

In another aspect of the invention, there is provided an energy absorbing module for use in a reusable energy absorbing crash attenuator. The module comprises a first module portion and a second module portion which are attached together; each of the module portions comprising plastic and having a combination of concave and convex curvature. The plastic preferably comprises high density polyethylene (HDPE). The energy absorbing module has a recess in a bottom edge thereof, with the recess being adapted to fit over and engage a rail on the crash attenuator so that the module is slidable thereon. The module is precompressed prior to installation, so that it is reboundable to almost its original installed configuration after being crushed in an impact.

The first and second module portions are attached together in opposing fashion at corresponding edges thereof, preferably by clips.

The invention, together with additional features and advantages thereof, may best be understood by reference to the following description taken in conjunction with the accompanying illustrative drawing.

BRIEF DESCRIPTION OF THE DRAWINGS

FIG. 7 is a plan view of a fender panel constructed in accordance with the principles of the present invention;

FIG. 8 is a side view of the fender panel of FIG. 7;

FIG. 9 is a left end view of the fender panel of FIG. 7;

FIG. 10 is a right end view of the fender panel of FIG. 7; and

FIG. 11 is a cross-sectional view taken along lines A-A of FIG. 7.

DESCRIPTION OF THE PREFERRED EMBODIMENT

Figure 1:
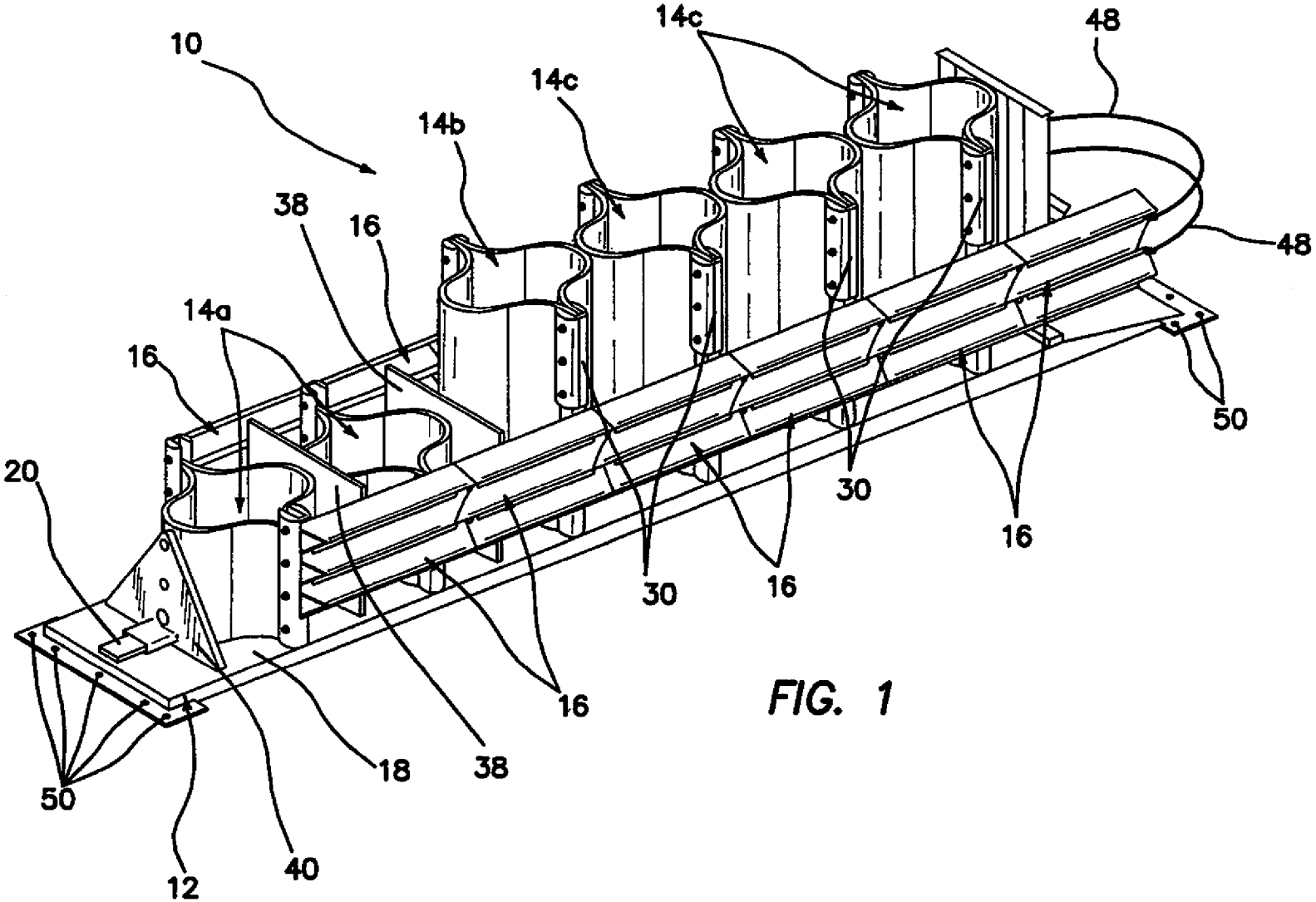
FIG. 1 is perspective view of a crash attenuator constructed in accordance with the principles of the present invention.
Figure 2:
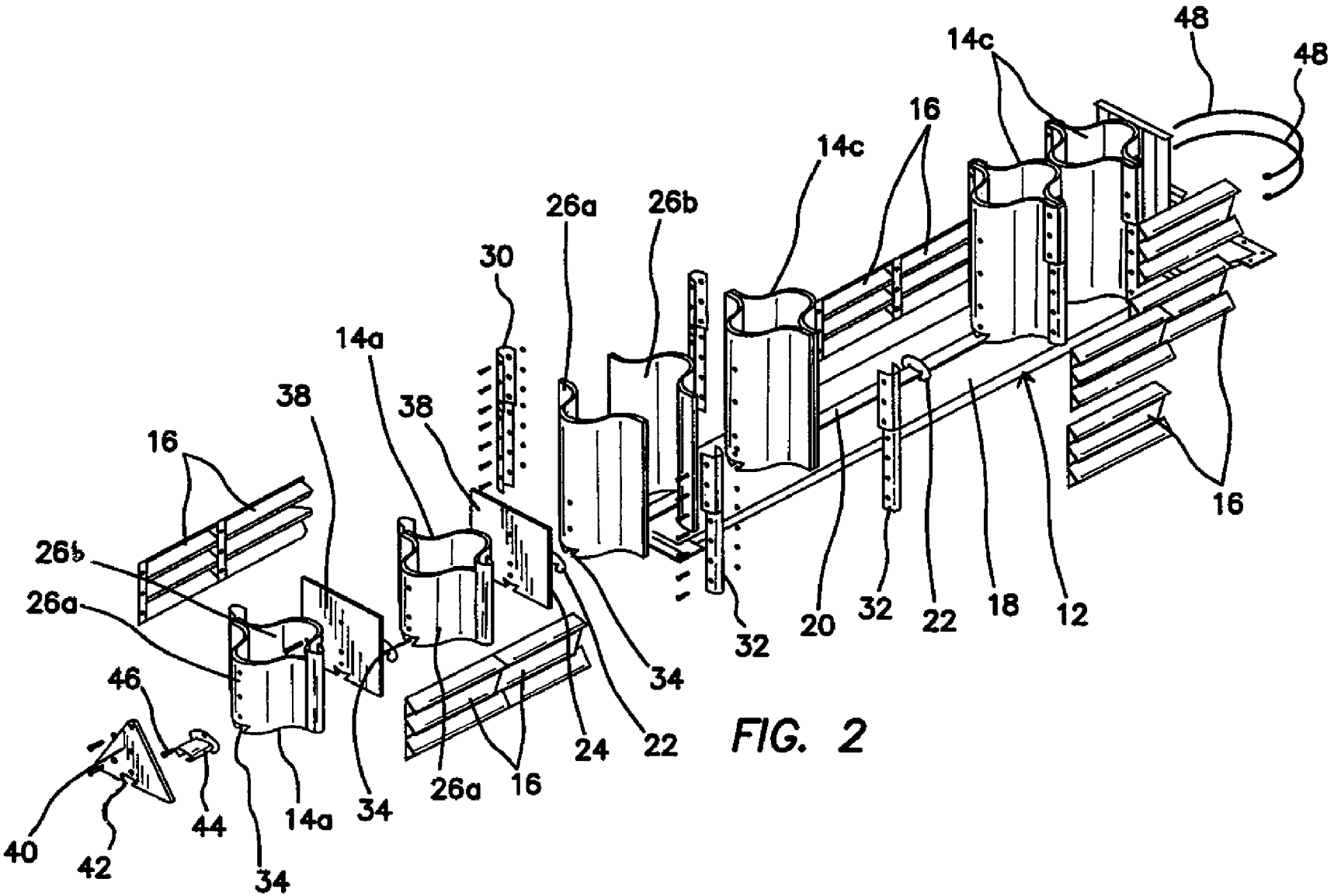
FIG. 2 is an exploded perspective view of the crash attenuator of FIG. 1, illustrating constructional details thereof.
Figure 3:
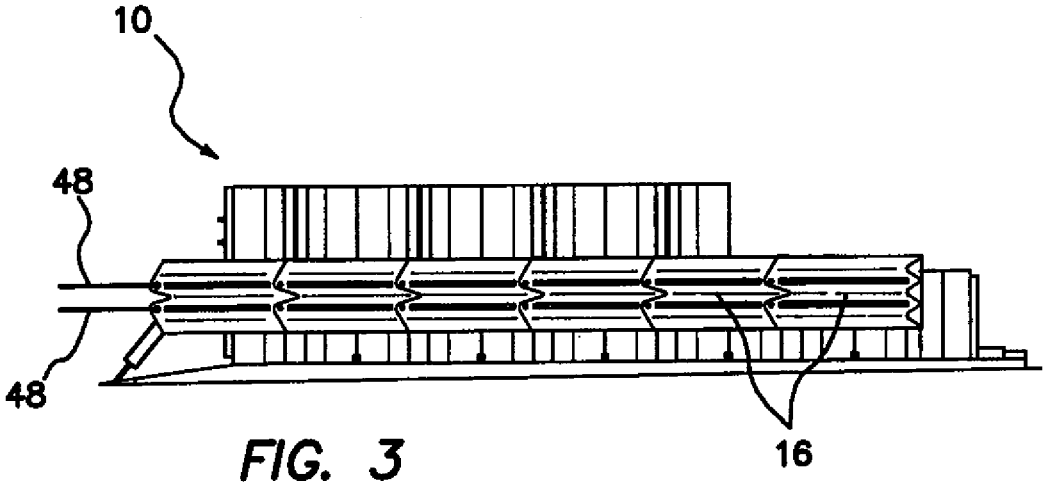
FIG. 3 is a side view of the crash attenuator of FIGS. 1 and 2.
Figure 4:
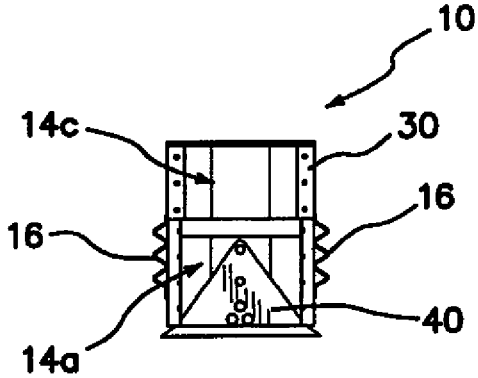
FIG. 4 is a rear end view of the crash attenuator of FIG. 3.
Figure 5:
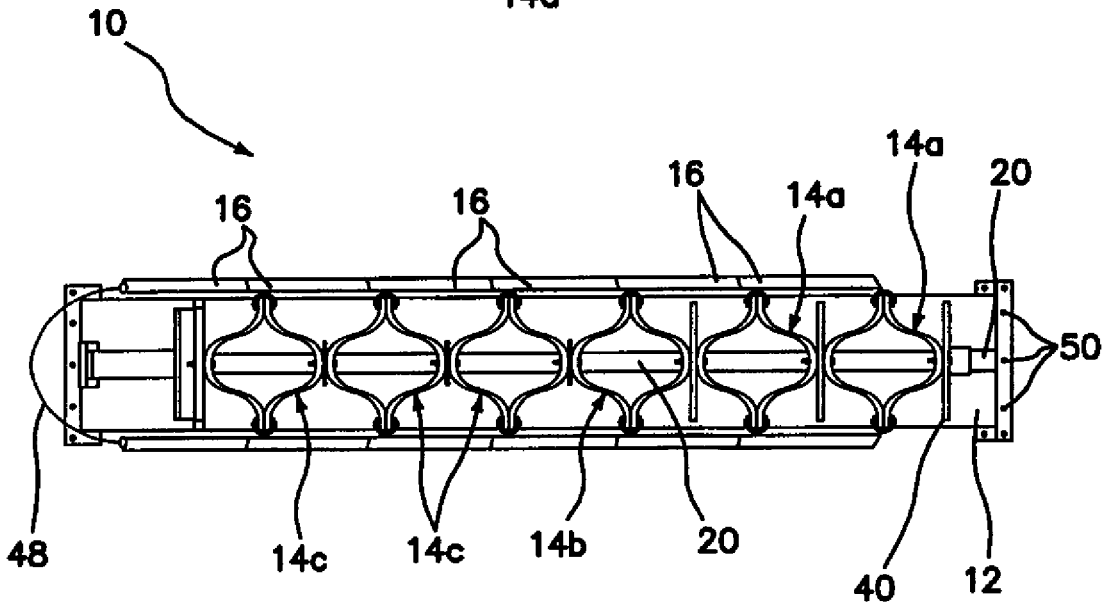
FIG. 5 is a top view of the crash attenuator of FIG. 3.

Referring now more particularly to the drawings, there is shown in FIGS. 1-5 a crash attenuator 10 which incorporates the features of the present invention. The major components of the attenuator 10 include a mounting base 12, preferably fabricated of steel or other suitable metal or material, a plurality of energy absorbing modules 14*a*, 14*b*, and 14*c*, and a plurality of fender panels 16. The inventive attenuator 10 is referred to in the traffic safety industry as a re-directive, non-gating crash cushion. It is designed to be employed between concrete bridge abutments and the like, usually for the purpose of protecting the occupants of an errant vehicle from the effects of a collision with such an immovable object. Occasionally, the inventive crash cushion may be utilized to protect an object which cannot withstand the force of an un-cushioned impact from a vehicle.

In a preferred embodiment, the crash attenuator 10 has a total length of approximately 255.25 inches (6.5 m). Its effective length is 196 inches (4.98 m). The device 10 measures 48.66 inches (1.24 m) wide, and is 53.5 inches (1.36 m) in height. Of course, the foregoing dimensions are merely representative of one currently preferred embodiment, and may vary considerably in accordance with desired application parameters, to be determined by competent traffic safety engineers having ordinary skill in the art.

Figure 6A:
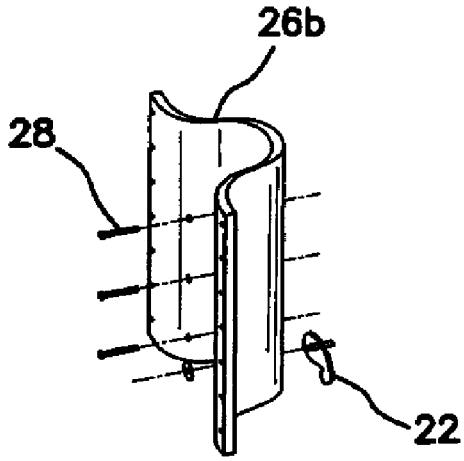
FIGS. 6A through 6D are isolation views illustrating individual module components of the crash attenuator of FIGS. 1-5.
Figure 6B:
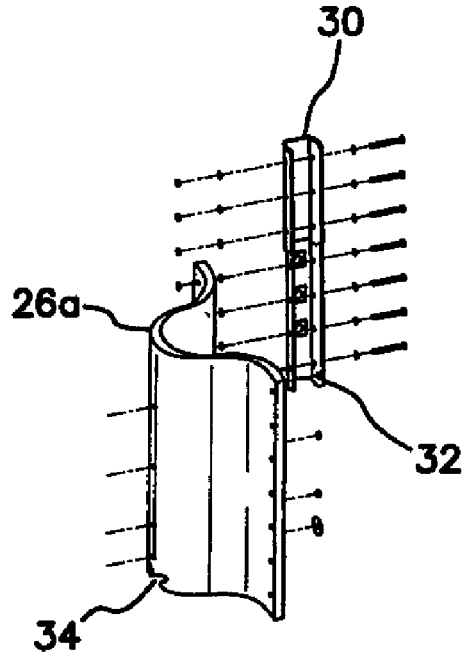
Figure 6C:
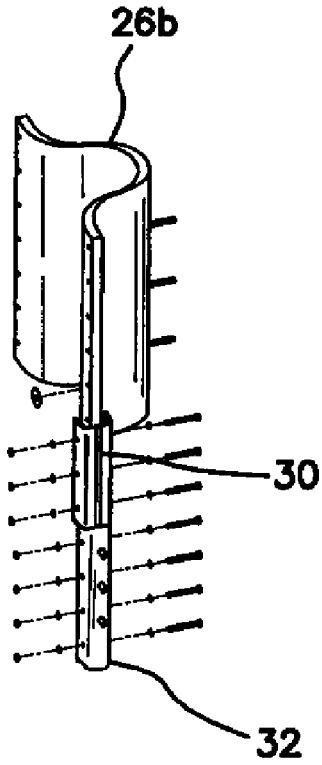
Figure 6D:
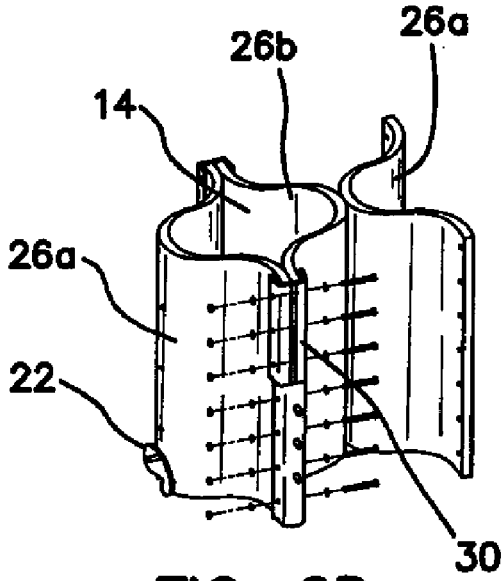

On the top smooth surface 18 of the mounting base 12 is disposed a rail 20, preferably having a dovetail configuration, for facilitating sliding of crash attenuator components therealong upon vehicular impact. Between adjacent modules 14 there is disposed a lateral support retaining plate 22 (FIGS. 2 and 6A), which has a dovetail-shaped recess 24 therein, which is adapted to mate with the rail 20. It should be noted, at this juncture, that the dovetail shape is presently preferred, but not essential to the invention. Alternative mating configurations, suitable for the purpose of creating a sliding engagement between the base 12 and the attenuator components disposed thereupon, can be employed instead.

Each of the modules 14*a*, 14*b*, and 14*c* are fabricated from a high-strength plastic, preferably high density polyethylene (HDPE), and are preferably manufactured using an injection molding process. Each module 14*a*, 14*b*, 14*c* comprises two halves 26*a* and 26*b*, respectively. The module halves 26*a*, 26*b* are preferably shaped with a combination of concave and convex curvature. In the illustrated, preferred embodiment of the crash attenuator 10, two heights of modules 14 are employed. Modules 14*a* are of a shorter height, and modules 14*b*, 14*c* are of a taller height. In a particularly preferred embodiment, modules 14*a* are approximately 24 inches (0.6 m) tall, and have a maximum wall thickness of approximately 1½ inches (38.1 mm) Module 14*b* is approximately 48 inches (1.22 m) tall, and has a maximum wall thickness of approximately 1½ inches (38.1 mm) Modules 14*c* are each approximately 48 inches (1.22 m) tall, and have a maximum wall thickness of approximately 1⅞ inches (47.6 mm).

The foregoing dimensions are representative only, as being favored in the preferred embodiment. Obviously, these dimensions may be substantially varied and remain within the scope of the disclosed invention. For example, height, width, length, and thickness of each module may be substantially varied, and the spacing between modules may also be varied. The thickness of one or more module may vary across the width of the module, rather than remaining uniform. The number of modules may be adjusted (six are presently preferred, as illustrated), and they may be changed to all be of substantially uniform height. That being said, the inventors have found that there are significant advantages to the preferred arrangement. As shown and described, the first two frontmost shorter modules are sized to be approximately the same height as the adjacent fender panels 16, which assists in alleviating the snagging of portions of an impacting vehicle on portions of the module. Arranging the modules 14 so that the rearmost modules 14*c* are of a greater wall thickness than the first two short modules 14*a* and the third tall module 14*b* (approximately 25% thicker in the preferred embodiment), has been found to increase the strength of the rearmost modules 14*c* by approximately 50%, which is advantageous particularly in effectively stopping the heavier vehicles.

As illustrated in the drawings, each module half 26*a* is attached to its mating module half 26*b* using a set of mechanical fasteners 28, which are preferably bolts. Additionally, each module 14*a*, 14*b*, 14*c* employs upper and lower clips 30, 32, respectively, with accompanying fastening hardware, to fasten each module half 26*a*, 26*b* together to make a single module assembly 14*a*, 14*b*, 14*c*. The module clips 30, 32 preferably incorporate an anti-snag guard thereon.

A recess 34 is molded into the bottom edge of each module half 26*a*, 26*b* of each module assembly 14*a*, 14*b*, 14*c*. In the preferred embodiment, this recess is dovetail-shaped, and matches the configuration of the rail 20. Thus, when the module 14*a*, 14*b*, 14*c* is mounted on the base 12, the recess 34 corresponds to the configuration of the rail 20, and thus is adapted to engage therewith.

The dovetail-shaped recess 34 is preferably centered about the spine of the convex surface of each module half 26*a*, 26*b*, and, as noted above, mates the module to the base rail, thus allowing for modules to compress and slide longitudinally upon impact, while retaining the modules from lateral or vertical displacement.

In addition to the engagement between the rail 20 and recess 34, the modules 14*a*, 14*b*, 14*c* are further restrained to the base 12 by retaining plates 22 disposed between adjoining modules, as discussed above. To alleviate snagging of an impacting vehicle on a re-direct impact, a lateral support stiffening rib 38 is disposed between the first two modules 14*a*, and a second rib 38 is disposed between the second module 14*a* and module 14*b*. These ribs 38 are preferably fabricated of HDPE, and in the preferred embodiment are approximately 29 inches (0.74 m) tall. As stated previously, of course, material selection and size may be changed in accordance with design parameters within the scope of the invention.

A nose piece 40 is disposed at the front end of the attenuator 10, and is mounted to the rail 20 via a recess 42, which is shaped similarly to recesses 24, 34 and is adapted to engage the rail 20 in the same manner A lateral support nose shoe 44 is slidably mounted on the rail 20 in the same manner as the aforementioned components, and joins the nose piece 40 to the first module 14*a* by means of a pin 46. Sliding friction of the nose shoe 44 is reduced by incorporating fiber-reinforced nylon slide inserts on the contact surfaces between the nose shoe 44 and the dovetail rail 20 on the base.

An important feature of the present invention is a base structure which greatly reduces the number of anchor bolts required for installation. In the preferred embodiment, a minimum of 10 and a maximum 14 ground-engaging bolts 50 are used to secure the base 12 to the ground. The primary load on the bolts 50 is horizontal since the bending load from the absorber elements on the aft panel is resisted by the forces at the end of the base structure. The bolts, whose primary loading is horizontal shear, are also adequate to resist the tension loads resulting form lateral force from the side impacts.

The side fender panels 16 are preferably made from high strength steel, approximately 0.125 inches (3.2 mm) thick. Once again, of course, material selection and dimensions can be varied without affecting the principles of this invention. The shape of the fender panels permits them to resist damage on impact, slide, and telescope during longitudinal compression of the attenuator 10. In the preferred embodiment, six sets of side fender panels 16 are utilized on each side, and are attached at their leading edge to corresponding lower edge clips 32 of each module, as shown. The rearmost set of side fender panels are retained at their trailing edge by two cables 48. These cables 48 permit the panels to telescope, stack, and minimize flaring of the panels during impact. In the preferred embodiment, the cables are comprised of wire rope, having a ⅜ inch (9.5 mm) diameter.

Side impact forces are resisted by each of the corrugated high strength steel fenders 16, as particularly shown in FIGS. 7-11. Use of high-strength steel and the proper cross-sectional shape assists in distributing the side impact forces to the attenuator ends and resists permanent deformation. Attached to the front of each fender panel 16 is a button fastener 52 which is designed to have two functions on the attenuator. The button has a head diameter that is larger then the slot opening and a base diameter smaller then the slot width. By attaching the buttons to the front of the fender panel each panel is placed on top of each other along the length of the attenuator. The button head holds the panels together by using a bolt which also allows the base of the button to slide in the slot when the attenuator is impacted. The sliding of the buttons in the slot allows the panels to telescope onto one another along the entire length of the attenuator.

The panels 16 nest together and over-lap like shingles. The rear edge of each panel is restrained by the button slider 52, which travels in a slot in the lower panel so that they telescope together as the plastic attenuators to which they are attached are compressed on impact.

The slots in the panels preferably run substantially along the entire length of each panel 16 and have two purposes. First the slots are used to hold the two panels together by using the button slider as described above. The button slider is placed towards the front of the panel. This allows a bolt to thread into the button slider and through a hole that is on the front portion of the panel. This is what holds panels together during the impact. The second function of the slots is to allow the panels to telescope onto each other when the impact occurs. The slider button has a base diameter that is slightly smaller then the slot width. This feature allows the buttons to slide when the impact occurs.

High strength steel is preferably utilized for the panels 16. The steel has a yield strength of approximately 100,000 psi and is able to resist permanent deformation from impact better than the lower strength steel used in existing fender panels. The edges of the panels 16 at the front and the rear have a chamfer or taper, that prevents gouging or galling, as the panels slide together and as they telescope during frontal impact.

Two vertically arranged sliders are preferably incorporated in each panel to provide better restraint and improve resistance from separation in reverse vehicle impacts. When assembled to the attenuator, the slider is at the forward end of the slot in the lower panel and is securely retained with a high tension bolt. As the panels telescope together, the slider travels aft in the slot in the lower panel and continues to retain the end of the upper panel. Existing fender panel designs do not retain the end of the panel in telescoping mode.

The plastic impact attenuator of the present invention has the ability to almost completely recover to its original shape after being fully compressed or flattened one time. This is the property of the high density polyethylene material utilized for the modules 14, that permits re-use of the attenuators in energy absorbing crash terminals. After the initial full compression which is accomplished prior to production assembly, the attenuator recovers to approximately 90% of its original shape. After this first compression, following compressions result in only about 1% loss in length. In addition, the energy absorbing capacity is correspondingly reduced after the first compression.

Several attenuator modules in a row are required in a crash terminal whose length is determined by the sum of the lengths of the individual modules. The length of the terminal is important to both minimize its structure and the installation space required. By fully pre-compressing the units before installation, the relatively large (10%) reduction in length which would occur after the initial crash terminal impact will not occur. The required length of the terminal is therefore substantially reduced by approximately 10%.

In summary, as described above, it is important for the attenuator modules to be subject to one full compression before installation on a crash terminal. The use of this initial pre-compression method prior to assembling the crash terminal is unique.

The inventive crash attenuator 10, because of the unique construction detailed above, is fully reusable after impact by a vehicle. As each module 14 and the fender panels 16 collapse during the impact, they are not permanently damage, and are reboundable to at least approximately 99% of their prior pre-crash length.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A reusable energy-absorbing crash attenuator, comprising:

a base;

a rail disposed on and extending along a length of said base; and a plurality of energy absorbing modules slidably disposed on said rail;

wherein each of said energy absorbing modules comprises a first module portion and a second module portion which are attached together; each of said module portions comprising plastic and having a combination of concave and convex curvature, and further wherein each of said first and second energy absorbing module portions has a recess in a bottom plastic edge thereof, said recess fitting over said rail to slidably dispose the energy absorbing module portion on the rail.

2. The crash attenuator as recited in claim 1, wherein each of said energy absorbing modules comprising high density polyethylene (HDPE).

3. The crash attenuator as recited in claim 1, and further comprising a plurality of fender panels disposed in adjoining end-to-end fashion along each side of the length of said crash attenuator, said fender panels being arranged to slide together in telescoping fashion upon impact of the crash attenuator by a vehicle.

4. The crash attenuator as recited in claim 1, wherein each of said recesses is dovetail-shaped.

5. The crash attenuator as recited in claim 1, and further comprising a nose piece disposed proximally of a first one of said energy absorbing modules and slidably disposed on said rail.

6. The crash attenuator as recited in claim 1, and further comprising a lateral support retaining plate disposed between adjacent ones of said energy absorbing modules.

7. The crash attenuator as recited in claim 6, wherein the lateral support retaining plate is slidably disposed on said rail.

8. The crash attenuator as recited in claim 1, wherein a frontmost one of said energy absorbing modules is shorter in height and a second one of said energy absorbing modules rearwardly of said frontmost module is taller in height, relative to the frontmost module.

9. The crash attenuator as recited in claim 8, where two adjacent frontmost ones of said modules are shorter in height, and remaining ones of said plurality of modules, rearwardly of the frontmost two modules, are taller in height.

10. The crash attenuator as recited in claim 1, wherein the recess in each said module is disposed in a concave or convex curvature of that module.

11. The crash attenuator as recited in claim 3, wherein said fender panels are each attached to corresponding ones of said energy absorbing modules by clips.

12. The crash attenuator as recited in claim 1, wherein at least one of said plurality of energy absorbing modules is comprised of module portions having a first material thickness, and at least one other of said plurality of energy absorbing modules is comprised of module portions having a second material thickness which is less than the first material thickness.

13. The crash attenuator as recited in claim 12, wherein the at least one of said plurality of energy absorbing modules is disposed rearwardly of the at least one other of said plurality of energy absorbing modules.

14. The crash attenuator as recited in claim 1, wherein said first and second module portions are attached together in opposing fashion at corresponding edges thereof.

15. The crash attenuator as recited in claim 1, and further comprising a lateral support stiffening rib disposed between adjacent ones of said energy absorbing modules.

16. The crash attenuator as recited in claim 15, wherein said lateral support stiffening rib is slidably disposed on said rail.

17. The crash attenuator as recited in claim 1, wherein each of said plurality of energy absorbing modules are pre-compressed.

18. The crash attenuator as recited in claim 1, and further comprising a mounting base having a width at least as great as a width of each of said energy absorbing modules and extending along a full length of said crash attenuator, said rail being disposed on said mounting base.

19. The crash attenuator as recited in claim 18, wherein said mounting base is comprised of metal.

20. An energy absorbing module for use in a reusable energy absorbing crash attenuator, said module comprising a first module portion and a second module portion which are attached together; each of said module portions comprising plastic and having a combination of concave and convex curvature, wherein each of said first and second module portions has a recess in a bottom plastic edge thereof, said recess being adapted to fit over and engage a rail on the crash attenuator so that the module portion is directly slidable thereon.

21. The module as recited in claim 20, wherein said energy absorbing module comprises high density polyethylene (HDPE).

22. The module as recited in claim 20, wherein said module is precompressed prior to installation, so that it is reboundable to almost its original installed configuration after being crushed in an impact.

23. The module as recited in claim 20, wherein said first and second module portions are attached together in opposing fashion at corresponding edges thereof.

24. The module as recited in claim 23, wherein said first and second modules are attached together with clips.

25. The module as recited in claim 20, wherein said recess is dovetail-shaped.

26. The module as recited in claim 20, wherein the recess is disposed in a concave or convex curvature of the module.

* * * * *